US005217362A

United States Patent [19]

Thompson et al.

[11] Patent Number: 5,217,362

[45] Date of Patent: Jun. 8, 1993

[54] METHOD FOR ENHANCED ATOMIZATION OF LIQUIDS

[76] Inventors: Richard E. Thompson, 27121 Puerta del Oro, Mission Viejo, Calif. 92691; Jerome R. White, 44755 Wyandotte, Hemet, Calif. 92544

[21] Appl. No.: 815,801

[22] Filed: Dec. 30, 1991

[51] Int. Cl.[5] ..... F23D 11/44

[52] U.S. Cl. ..... 431/11; 431/208; 239/13; 239/135

[58] Field of Search ..... 431/11, 208; 239/13, 239/135; 110/250, 243

[56] References Cited

U.S. PATENT DOCUMENTS

| | | | |
|---|---|---|---|
| 4,558,664 | 12/1985 | Robben | 431/11 |
| 4,718,358 | 1/1988 | Nomi et al. | 110/250 |
| 4,765,773 | 8/1988 | Hopkins | 239/135 |
| 4,909,164 | 3/1990 | Shohet et al. | 110/250 |
| 5,134,946 | 8/1992 | Poovey | 110/250 |

OTHER PUBLICATIONS

Daniel J. Maloney and James F. Spann, "Secondary Atomization of Coal-Water Fuel Droplets resulting from Exposure to Intense Radiant Heating Environments", presented at the American Chemical Society, NY, Apr. 1986.

Peter M. Walsh et al., Twentieth Symposium International on Combustion/The Combustion Institute, 1984/pp. 1401-1407.

John C. Kramlich, Twentieth Symposium International on Combustion/The Combustion Institute, 1984/pp. 1991-1999.

*Primary Examiner*—Carroll B. Dority

*Attorney, Agent, or Firm*—Cooley Goodward Castro Huddleson & Tatum

[57] ABSTRACT

In a process for atomizing a slurry or liquid process stream in which a slurry or liquid is passed through a nozzle to provide a primary atomized process stream, an improvement which comprises subjecting the liquid or slurry process stream to microwave energy as the liquid or slurry process stream exits the nozzle, wherein sufficient microwave heating is provided to flash vaporize the primary atomized process stream.

11 Claims, 1 Drawing Sheet

METHOD FOR ENHANCED ATOMIZATION OF LIQUIDS

ACKNOWLEDGEMENTS

This invention was supported in part by grants from the Department of Energy. The U.S. Government has rights in this invention as a result of the support.

INTRODUCTION

1. Technical Field

This invention is directed to large-scale atomization processess, particularly atomization of liquids for combustion, incineration, and spray drying processes.

2. Background

The atomization of slurries and liquids is an important aspect of combustion, incineration, and spray drying processes since the effectiveness of the process is often dependent upon the range of drop sizes generated by the atomizer. By achieving finer drop sizes through enhanced atomization, the process can generally occur in a more rapid and efficient manner. In the atomization and combustion of fossil fuels, for example (e.g. coal-water mixtures, coal-oil mixtures, heavy oils, black liquor, etc.), it is important to disperse the fuel very quickly and expose it to the back radiation and recirculated hot combustion products from the flame zone that provide energy for further volatilization and combustion. By improving the atomization process, a more complete combustion of the fuel, better carbon burnout, shorter flames, and less agglomeration and quenching can be obtained. Finer drop sizes also enhance the liquid waste incineration process by providing better distribution of the process stream within the incinerator, and hence, more even heating and better contact with the hot recirculating gases. Similarly, spray drying processes can also be further enhanced with finer atomization in that a finer drop size produces more even heat transfer and product distribution, thereby alleviating hot spots or agglomerated lumps.

High-solids-content slurries and two-component liquids containing high water functions represent particularly difficult process streams to atomize. In order to prevent plugging, slurries generally require relatively large atomizer holes. When combined with the slurry's non-newtonian fluid properties, there is a tendency to form large drops that is difficult to overcome. In addition, the various components of a slurry may heat and vaporize at different rates, leaving a sticky, half-melted solid behind, after the more volatile components have vaporized. The burnout of these solid components, which agglomerate to a greater extent under poor atomization conditions, can dictate overall combustion efficiencies. Finally, for those cases where water is a major component of the slurry, the ignition is typically delayed as energy is absorbed to heat and vaporize the water. The water in the slurry must be driven off before satisfactory ignition, combustion, and complete carbon burnout can be achieved. Atomization is particularly critical under these circumstances because a portion of the energy that would normally go into heating and devolatilization of the fuel (or waste) is absorbed in the vaporization of the water. Therefore, it is important to disperse the slurry very quickly via a fine atomization process in order to accelerate the evaporation and devolatilization processes.

With respect to viscous or tarry hazardous waste sludges, one of the major problems encountered in their thermal destruction is the inadequate atomization and dispersion of the tar or slurry-like material in the flame zone of the incinerator. Atomizers designed for liquid fossil fuels are often ineffective in incinerator applications because the particles plug the passages or erode the atomizer due to their abrasive nature. Quite often, an irregular spray pattern develops or the drop size of the tar or slurry material is too large for effective thermal destruction. Large droplets of fused organic and inorganic waste material can escape the combustion zone and may only be partially destroyed, resulting in a failure to meet the required destruction efficiency.

Current conventional liquid atomizers are in widespread use for many combustion systems and other industrial applications where fine liquid droplets are desired. Most conventional atomizers can be classified into two major groups, pressure or pneumatic, based upon their principle of operation. Pressure atomizers utilize small orifice diameters, high fuel supply pressures and internal swirl chambers to atomize the liquid. Pressure atomizers are generally considered to be unsuitable for atomization of slurries, particularly those with high viscosity and high solids loadings. These fuel properties often result in pluggage, erosion and excessively high fuel supply pressure requirements.

Pneumatic atomizers rely upon a supply of compressed air or stream to atomize the liquid fuel. Internally mixed pneumatic atomizers are less well suited for use with heavy, viscous, and slurry type fuels due to their complicated flow paths as well as high internal velocities for the fuel or fuel/gas mixtures. Erosion, high pressure drops and/or plugging can be significant operating problems with some designs. Externally mixed pneumatic atomizers utilize steam or air orifices directed at the base of the emerging fuel stream to create droplets by a shearing or blasting action. A penalty of this design is the relatively high gas comsumption rates needed for effective atomization.

The subject of this patent is an enhanced atomization process that addresses many of the limitations of conventional atomizers in applications involving high solids content slurries and viscous or tarry materials. The process was developed with the objective of providing a number of desirable characteristics which include:

- an ability to atomize slurries having different viscosities and solids loading;
- relatively large passages to minimize plugging;
- moderate pressure drop;
- moderate use of secondary atomizing fluids (air, steam, etc);
- compatibility with a range process stream properties and wear resistant parts to withstand slurry abrasion;
- convenient service and adjustment provisions for field maintenance.

SUMMARY OF THE INVENTION

By exposing a liquid or slurry process stream to direct microwave heating immediately upon exiting a primary atomizer, enhanced secondary atomization can be achieved through the rapid heating and explosive boiling of the process stream. Microwave enhanced atomization can be achieved by several different methods. One approach entails the direct microwave heating of a stream or drop at the exit of an atomizer in an intense microwave field. An extension of this approach to higher power levels involves the creation of a microwave plasma torch to rapidly heat and vaporize the process stream upon contact. In order to augment the microwave heating and secondary atomization, additives to the process stream can be used to either enhance the absorption of the microwave energy or to achieve flash vaporization more rapidly when exposed to microwave heating.

The microwave cavity will surround the primary atomizer at the tip of the burner or spray dryer. Because of the heat loading associated with combustion applications, the cavity will be air-cooled, with one or more openings used to allow air to pass from the burner windbox through the cavity. These openings typically will be oriented in a manner so as to provide some swirl to the air that enters the cavity. Thus, the cavity itself will form a bluff body, similar to the normal impeller in a liquid fuel burner, and will provide flame anchoring and stabilization characteristics (see FIGS. 1 and 2). Spray drying applications do not have the same cooling requirements and thus do not require cooling of the microwave cavity aside from that provided by the process stream. Applications of the microwave enhanced atomization system include, but are not limited to, the combustion of fossil fuels, waste fuels, hazardous wastes, and spray drying.

BRIEF DESCRIPTION OF THE DRAWINGS

The invention will be better understood by reference to the following detailed description of specific embodiments when considered in combination with the enclosed drawings, wherein:

FIG. 1 is a schematic diagram of a microwave cavity provided at the exit of a spray nozzel or atomizer (10). The nozzel is surrounded by the cavity body (20) which in this embodiment is provided with a number of entrance slots (30) for gas recirculation and an exit throat (40) through which the atomized liquid passes. FIG. 2 shows a microwave cavity configuration that can be installed in a commercial burner. The atomizer (10) is surrounded by a microwave cavity (20), as in FIG. 1 above. Tube 25 connects cavity 20 to a source of microwave energy. The cavity is located in the water-cooled furnace wall (50) of a commercial furnace. A refractory throat (40) with studded tubes is provided between the microwave cavity and the combustion chamber of the furnace. Secondary air is provided through an air register door (35). Other components of the burner installation include an impeller (60), a register drive rod (70), a lighter (80), and a centering support (90).

DESCRIPTION OF SPECIFIC EMBODIMENTS

Figure 1:
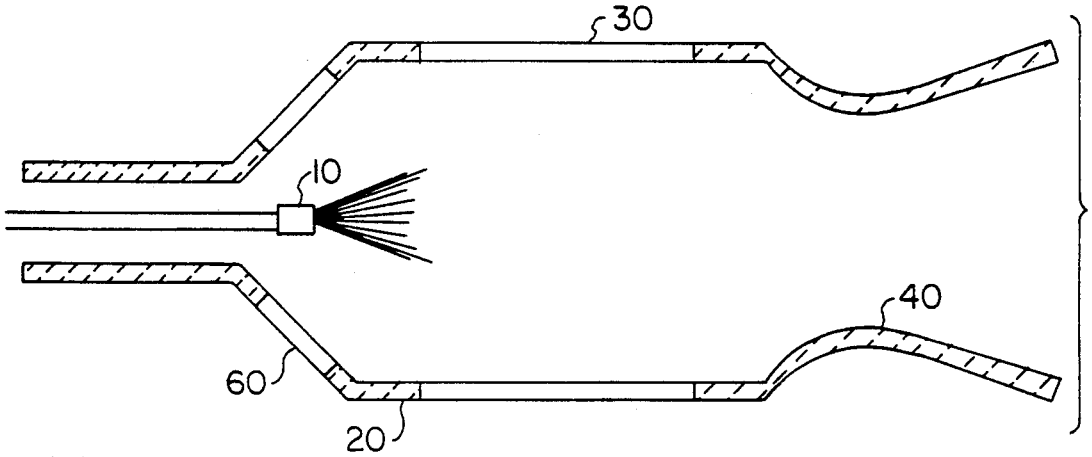
FIGS. 1 and 2 show microwave-enhanced atomization according to the process of the invention.
Figure 2:
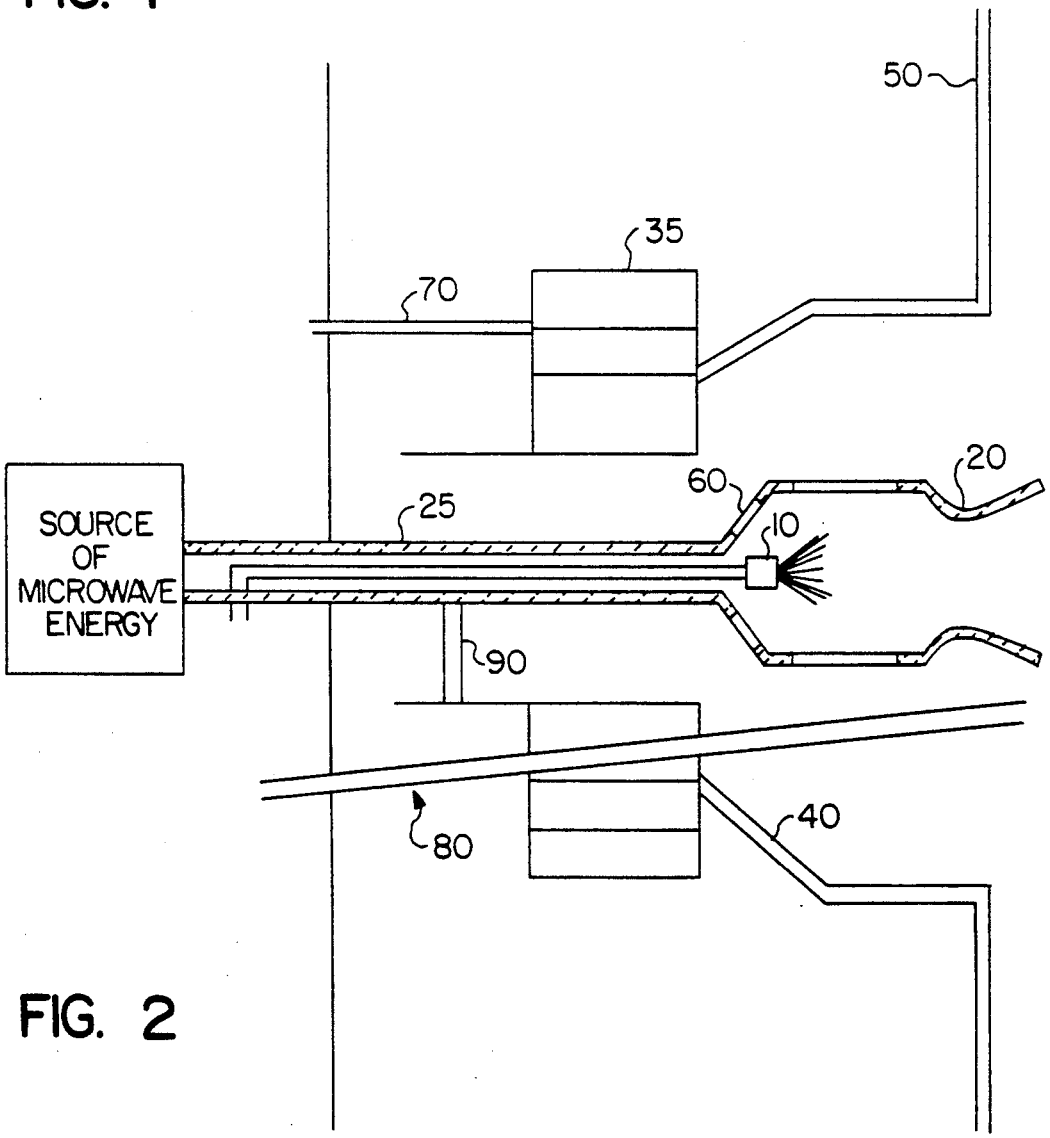

The present invention comprises a novel method for enhancing the atomization of liquids and slurries through the use of microwaves. The following description of the invention is provided to enable any person skilled in the art to make and use the invention. Various modifications to the disclosed embodiments will be readily apparent to those skilled in the art, and the generic principles defined herein can be applied to other embodiments. Thus, the present invention is not intended to be limited to the embodiments shown, but is to be accorded the widest scope consistent with the principles and novel features of the invention.

In a broad sense, the invention comprises the use of microwave energy to efficiently and economically atomize process streams (i.e. liquids or slurries) to fine droplets, or a cloud of droplets and solids. The invention can be used in the combustion, incineration, or spray drying processes requiring the atomization of viscous fluids, two component mixtures, and slurries, including high solids fraction process streams. Examples of fossil fuels which would exhibit improved combustion characteristics due to their enhanced atomization include coal-oil mixtures, coal-water mixtures, heavy oils, tars, and black liquor. Examples of waste fuels and hazardous wastes include solvent recovery sludges, distillation tars, still bottoms, and decanter tank sludge. Spray drying applications in which the enhanced atomization provides improved distribution include pharmaceuticals manufacturing and food processing industries.

The microwave field will be applied directly at the exit of a primary atomizer or to process streams entering a microwave torch (described in subsequent paragraphs). The atomization process is enhanced by providing very rapid heat addition to individual droplets so as to achieve the boiling point very quickly. The secondary atomization subsequently occurs due to the explosive boiling and droplet shattering. In addition, the rapid microwave heating will reduce the ignition time of relatively large droplets in order to increase their potential for complete combustion prior to escaping the flame zone. The enhanced atomization of the process achieved by microwave heating allows the use of atomizers that otherwise would produce drop sizes that were unacceptable. Atomizers with larger passages to prevent plugging can be used in some applications.

The process variables that determine the heating rate include the microwave frequency, the strength of the microwave electric field, the dielectric properties of the atomized fluid, and geometry factors concerned with the shape and alignment of the process stream relative to the field.

In this regard, the direct microwave heating approach focuses the microwave field on the spray cone prior to its breakup into droplets. The geometry of the spray cone, as a continuous film parallel to the axis of the microwave field, permits greater coupling of the microwaves to the process stream than could be achieved with individual droplets. By maintaining the field parallel to the spray cone axis, the field strength within the stream is equivalent to the field strength in the surrounding free space. In comparison, if the field were directed perpendicular to the axis of the spray cone, or further downstream where the process stream had broken up into pseudo-spherical droplets, the field strength within the stream compared to the surrounding free space would only be on the order of 5 percent. By achieving such strong coupling, unusually fast microwave heating can be obtained so that large amounts of energy may be imparted to the process stream, even in the short axial distance that the spray cone normally exists before breaking up. In spite of this strong coupling, however, enhanced atomization may require moderate to high field strengths or preheating of the process stream prior to its reaching the atomizer.

An extension of the direct microwave heating approach to higher power levels involves creating a microwave plasma within, or at the end of, the atomizer tip. In this approach, the microwave field is concentrated by means of metal electrodes creating a high temperature plasma as atomizing air passes through the nozzle. The microwave field is produced by an industrial microwave generator with a power supply capable of producing the high power levels required to generate a plasma. As this hot plasma mixes with the droplets, it will rapidly vaporize the liquid component and fracture the droplets. In addition, the solid fraction of a multi-component stream will be dispersed throughout the flame zone, minimizing the tendency for the solid particles to fuse, agglomerate, and yield burnout problems. An additional potential side benefit of this approach is the characteristic of these plasma fields to produce sonic energy that may also enhance the droplet vaporization and breakup process. The power supply ripple that is typical of industrial microwave generators causes inadvertant microwave sparks to "sing" with a sound that is a harmonic of the electric supply line frequency. However, this power supply harmonic frequency will be intentionally modulated at much higher frequencies ranging from 100 kHz to 10 MHz, depending upon the effect on the droplet vaporization. Thus, the potential exists for a very rapid two-step heating process involving internal heating of the spray cone sheet after which the droplet cloud immediately encounters a hot microwave plasma which further heats the droplets by conduction and radiation (IR, visible and UV). An important benefit of the plasma heating operating regime is that the heating mechanism is not dependent upon the dielectric properties of the process stream and therefore has a wider range of application than direct microwave heating at lower power levels.

The microwave power requirements to achieve secondary atomization can be decreased through the use of high dielectric additive to increase the microwave absorption characteristics of the process stream. Two dielectric property parameters directly impact a materials ability to be heated by microwave. The first parameter, K, the relative dielectric constant, is the ratio of the dielectric constant of the material divided by the dielectric constant of a vaccum. The second parameter, tan $\delta$, the loss tangent, is the ratio of the loss factor divided by the dielectric constant (permittivity). In accordance with this invention, a suitable material for use as an additive has a dielectric constant greater than that of the liquid or slurry process stream being atomized. Generally, desirable additives will have dielectric properties so that their relative dielectric constant (K) is in the range of from 4 to 100 or their loss tangent (tan $\delta$) is in the range of from 0.05 to 1.0, or both parameters are in the indicated ranges. Additives effective in this regard include halogenated alkaline earth metals, such as $CaCl_2$, at levels ranging from 0.01 to 10 percent, and preferably 1 percent. The introduction of a $CaCl_2$ solution into a process stream to a 1 percent level significantly alters its microwave absorption characteristics while not appreciably affecting the overall fluid properties of the process stream. For example, the microwave heating of a coal-water mixture (CWM) plus 1 percent $CaCl_2$ additive at 0.915 GHz at 65° C. has a loss factor that is approximately 50 times that of CWM made with plain water. Therefore, the required field strength for the same power density and volumetric heating rate is only 14 percent of that required for a plain CWM.

Enhanced secondary atomization with microwaves can also be achieved at lower power levels by utilizing a low boiling point additive or emulsification agent. An additive is considered to have a low boiling point if its boiling point is less than that of the liquid or slurry being atomized. Additives with boiling points less than 200° C. are preferred. If the two components are immiscible and evenly dispersed, as in an emulsion, the rapid heating in a microwave field can lead to nucleation and a rapid growth of vapor bubbles in the droplet. As these vapor pockets burst, an explosive boiling phenomena can occur which shatters the waste or slurry droplet into a fine mist of droplets that are widely dispersed at substantial velocities by the rapidly growing vapor cloud propelling them. For those cases where the additive is miscible with the process stream, one large vapor pocket forms at the center of the droplet as opposed to multiple nucleation sites associated with the explosive boiling mechanism described above. As the central vapor pocket grows to the point that the droplet shell can no longer contain the vapor, it vents, causing the droplet to collapse into a ligament of fluid that forms several smaller droplets based on the surface tension properties of the fluid. An extensive list of potential low boiling point compounds and their key critical properties which could be used in one of the aforementioned processes is included in Tables 1 and 2. The amount of low boiling point material can range from 0.1 to 50 percent of the process stream, more preferably 1 to 10 percent, depending upon the additive and process stream properties. The two most promising low boiling point additives are methanol and propane; methanol, because of its relative high microwave absorbance characteristics would be used in applications where dielectric properties of the process stream were a concern and propane where the process stream had favorable dielectric properties.

Enhanced atomization through microwave heating will be effective for process streams with a viscosity ranging from 50 to 9,000 SUS (@100° F.) and solids loadings ranging from 10 percent to 95 percent; however the process will be most effective when applied to process streams of high viscosity (>300 SUS @ 100° F.) or high solids loadings (>25% solids fraction).

The pressure at which the process is carried out is not critical and may be varied widely. Generally, the pressure will range from about 0.01 to 100 atm. The residence time in the microwave beam will generally range from 0.001 to 10 seconds.

The process is applicable to any stream issuing forth from an orifice on an otherwise physically enclosed surface. More preferably, the process stream will be atomized in either an acoustically assisted atomizer, electrostatically augmented atomizer, or, even more preferably, a twin-fluid atomizer.

The process is applicable over a broad temperature range inclusive from just above the freezing point to the maximum temperature the process stream can be pumped and injected into the enclosure. More preferably, the process stream will range from standard temperature (70° F.) to near the boiling point of the most volatile constituent within the process stream in order to minimize the microwave field energy required.

TABLE 1

THERMODYANAMIC DATA ON LOW BOILING POINT COMPOUNDS AND COMMON WASTE LIQUIDS

| Number | Name | Boiling Temp $T_b$, C. | Heat of Evap. $h_{fg}$, cal | *Spec. Heat $C_p$, cal/gm C. | Critical Temp. $T_c$, C. |
|---|---|---|---|---|---|
| 1 | Acetone | 56.2 | 125 | 0.53 | 235.5 |
| 2 | Amyl acetate | 148 | 81 | 0.46 | — |
| 3 | Amyl chloride | 108.2 | — | — | — |
| 4 | Benzene | 80.1 | 94 | 0.41 | 288.9 |
| 5 | Bromobutane | 101.6 | — | — | — |
| 6 | Bromomethane | 3.6 | — | — | — |
| 7 | Bromopropane | 70.9 | — | — | — |
| 8 | Butyric acid | 163.5 | — | — | — |
| 9 | Carbon tetrachloride | 76.8 | 46 | 0.20 | 283.1 |
| 10 | Chloroform | 61.3 | 59 | 0.23 | 263 |
| 11 | Cresols (o, m, p, avg) | ~200 | 119 | 0.49 | 424–432 |
| 12 | Cyclohexane | 81.4 | 93 | 0.43 | 280.4 |
| 13 | Dibromochloromethane | 150.2 | — | — | — |
| 14 | Dibromomethane | 97 | — | — | — |
| 15 | Dichlorobutanes | 104–154 | — | — | — |
| 16 | Dichloroethanes | 57–84 | — | — | ~250 |
| 17 | Dichloropropanes | 69–120 | — | — | — |
| 18 | Diethyl ether | 34.6 | 84 | 0.54 | 192.6 |
| 19 | Dinitropropane | 103–186 | — | — | — |
| 20 | Ethanol | 78.5 | 204 | 0.58 | 243 |
| 21 | Ethyl acetate | 77.5 | 102 | 0.46 | — |
| 22 | Ethyl formate | 54.3 | 97 | 0.51 | — |
| 23 | Formamide | 111 | — | — | — |
| 24 | Glycerol | 290 | 198 | 0.60 | (452) uncertain |
| 25 | Glycol | 197 | 191 | 0.57 | (374) uncertain |
| 26 | Heptane | 98.4 | 84 | 0.49 | 267.1 |
| 27 | Hexane | 69.0 | 89 | 0.60 | — |
| 28 | Methanol | 64.7 | 262 | 0.60 | 240 |
| 29 | Methyethyl ketone | 78.2 | 106 | 0.55 | 262 |
| 30 | Methylene chloride | 40.5 | 78.6 | 0.29 | 237 |
| 31 | Methylisobutyl ketone | 119 | — | 0.46 | — |
| 32 | Octane | 126 | 81 | 0.58 | 296 |
| 33 | Phenol | 182 | 126 | 0.56 | 421.1 |
| 34 | Propane | −42.1 | 72 | 0.52 | 96.8 |
| 35 | 1-propanol | 97.2 | 164 | 0.59 | 263.6 |
| 36 | 2-propanol | 82.3 | 159 | 0.62 | 235 |
| 37 | Pyrrole | 130 | — | — | — |
| 38 | Thiophene | 84.2 | — | — | 307 |
| 39 | Toluene | 110.6 | 93 | 0.42 | 320.6 |
| 40 | Trichlorobenzenes | 208–219 | — | — | — |
| 41 | Trichloroethane | 74.1 | 61 | 0.26 | — |
| 42 | Trichloroethylene | 87(85.7) | 65(67) | 0.23 | — |
| 43 | Trioxane | 114.5 | — | — | — |
| 44 | Turpentine | 156 | 69 | 0.41 | — |
| 45 | Water | 100 | 540 | 1.00 | — |
| 46 | Xylene, o | 144.4 | 94 | 0.4 | 359 |

*Room Temperature

TABLE 2

DIELECTRIC DATA ON LOW BOILING POINT COMPOUNDS AND COMMON WASTE LIQUIDS

| Number | Name | Rel Diel. Const. $K = \epsilon'/\epsilon_o$ | Loss Tangent $\tan\delta = \epsilon''/\epsilon'$ | Loss Factor $\epsilon''$ | Temp. C. | Wavelength cm | Freq. GHz |
|---|---|---|---|---|---|---|---|
| 1 | Acetone | 21/19 | — | 1.32/1.02 | 20/40 | 10.4 | — |
| 2 | Amyl acetate | 4.6/4.3 | 0.42/0.27 | — | 20/50 | 10 | — |
| 3 | Amyl chloride | *6.6 | — | — | 11 | — | |
| 4 | Benzene | *2.28 | — | — | — | — | |
| 5 | Bromobutane | 6.7/6.2 | — | 0.79/0.51 | 25/55 | 10 | — |
| 6 | Bromomethane | 9.24 | — | 0.6 | 25 | 10 | — |
| 7 | Bromopropane | 7.97/7.06 | — | 0.66/0.44 | 25/55 | 10 | — |
| 8 | Butyric acid | 2.96 | — | 0.14 | 20 | 9 | — |
| 9 | Carbon tetrachloride | 2.17 | 0.004 | — | 25 | — | 3 |
| 10 | Chloroform | 4.82 | — | 0.379 | 25 | 9.72 | — |
| 11 | Cresols | *10–12 | — | — | 25 | — | — |
| 12 | Cyclohexane | *2.025 | — | — | — | — | — |
| 13 | Dibromochloromethane | 2.54/2.51 | — | <0.003 | 25/40 | 10 | — |
| 14 | Dibromomethane | 4.62/4.58 | — | 0.46/0.31 | 25/55 | 10 | — |
| 15 | Dichlorobutanes | 9.06/7.28 | — | 1.2/2.0 | 25/55 | 10 | — |
| 16 | Dichloroethane, 1, 2 | 9.98/8.63 | — | 1.0/0.57 | 25/55 | 10 | — |
| 17 | Dichloropropane, 1, 3 | 10.2 | — | 1.34 | 25 | 9.72 | — |
| 18 | Diethyl ether | 4.24 | — | 0.11 | 25 | 10 | — |
| 19 | Dinitropropane, 2, 2 | 33.6 | — | 8 | 60 | 10 | — |
| 20 | Ethanol | 6.5 | 0.250 | 1.63 | 25 | — | 3 |
| 21 | Ethyl acetate | 6.06/5.71 | 0.33/0.24 | — | 20/40 | 10 | — |
| 22 | Ethyl formate | *7.1 | — | — | 25 | — | — |
| 23 | Formamide | 93.6/77.7 | 40.8/44.4 | — | 20 | 23.6/8.4 | — |

TABLE 2-continued

DIELECTRIC DATA ON LOW BOILING POINT COMPOUNDS AND COMMON WASTE LIQUIDS

| Number | Name | Rel Diel. Const. $K = \epsilon'/\epsilon_o$ | Loss Tangent $\tan\delta = \epsilon''/\epsilon'$ | Loss Factor $\epsilon''$ | Temp. C. | Wavelength cm | Freq. GHz |
|---|---|---|---|---|---|---|---|
| 24 | Glycerol | 10.3 | 0.8 | — | — | 13.45 | — |
| 25 | Glycol | 12 | 1.0 | — | 25 | — | 3 |
| 26 | Heptane | 1.97 | 0.0001 | — | 25 | — | 3 |
| 27 | Hexane | *1.89 | — | — | 20 | — | — |
| 28 | Methanol | 23.9 | 0.640 | — | 25 | — | 3 |
| 29 | Methyethyl ketone | *18.5 | — | — | 20 | — | — |
| 30 | Methylene chloride | *9.08 | — | — | 20 | — | — |
| 31 | Methylisobutyl ketone | *13.1 | — | — | 20 | — | — |
| 32 | Octane | *1.95 | — | — | 20 | — | — |
| 33 | Phenol | *978 | — | — | 60 | — | — |
| 34 | Propane | *1.9 | — | — | — | — | — |
| 35 | 1-propanol | 3.7 | 0.67 | — | — | — | — |
| 36 | 2-propanol | *18.3 | — | — | 25 | — | — |
| 37 | Pyrrole | 8.05 | — | 0.87 | 25 | 10.7 | — |
| 38 | Thiophene | 2.76 | — | 0.013 | 20 | 10.7 | — |
| 39 | Toluene | *2.38 | — | — | 25 | — | — |
| 40 | Trichlorobenzenes | 3.8 | 0.23 | — | 26 | — | 3 |
| 41 | Tichloroethylene, 1, 1, 1 | 7.2/6.6 | — | 0.49/0.37 | 20/40 | 10 | — |
| 42 | Trichloroethylene | *3.4 | — | — | 16 | — | — |
| 43 | Trioxane, 1, 3, 5 | 15.75/15.04 | — | 2.16/1.62 | 65/80 | 10.4 | — |
| 44 | Turpentine (terpens) | *2.3/2.8 | — | — | 20 | — | — |
| 45 | Water | 76.7/52 | 0.16/0.047 | — | 25/95 | — | 3 |
| 46 | Xylene, o | *2.57 | — | — | 20 | — | — |

*Low frequency values from CRC Handbook Chem. & Phys., 51st Ed. and NBS Circular 51A As discussed previously, the process stream can also have a high dielectric additive blended prior to atomization, mixed within the atomizer, or downstream of the atomizer within the microwave field. High dielectric additives include any material with a dielectric constant greater than the process stream. Examples of these high dielectric additives are halogenated alkaline earth metals such as calcium chloride. The process stream can also have low boiling point additives blended prior to atomization and microwave heating in order to enhance the secondary atomization of the process stream through their flash vaporization. Low boiling point additives include any material with a boiling point lower than that process stream. Examples of these low boiling additives include propane and methanol, the latter of which can also be used to potentially boost the microwave energy absorbance by virtue of its relatively high dielectric constant.

The microwaves themselves may be applied at various points along the process stream or droplet trajectory from the tip of the primary atomizer to the point of ignition, more preferably in the region immediately downstream of the point of process stream injection into the primary chamber where the combustion, incineration, or drying takes place.

The field of strength of the microwave generator is typically tailored to achieve the optimum atomization, as determined by the drop size distribution, with the minimum power consumption. The amount of additives used in the process stream vary with the properties of the process stream as well as trade-offs associated between the type and quantity of additive and the incremental improvement in required microwave power level.

All publications and patent applications mentioned in this specification are herein incorporated by reference to the same extent as if each individual publication or patent application was specifically and individually indicated to be incorporated by reference.

The invention now being fully described, it will be apparent to one of ordinary skill in the art that many changes and modifications can be made thereto without departing from the spirit or scope of the appended claims.

What is claimed is:

1. In a process for atomizing a slurry or liquid process stream in which a slurry or liquid is passed through a nozzle to provide a primary atomized process stream, an improvement which comprises:

subjecting said liquid or slurry process stream to microwave energy as said liquid or slurry process stream exits said nozzle, wherein sufficient microwave heating is provided to flash vaporize said primary atomized process stream.

2. The process of claim 1, wherein microwave energy is achieved by contacting said liquid or slurry process stream with a direct microwave field.

3. The process of claim 1, wherein said liquid or slurry process stream forms an exit cone, having a principal axis, on said nozzle prior to initial atomization and said microwave field is oriented parallel to said principal axis of said exit cone.

4. The process of claim 3, wherein orientation of said field is controlled by surrounding said nozzle with a microwave cavity shaped to provide said orientation.

5. The process of claim 4, wherein said microwave cavity comprises an entrance for said nozzle, an entrance for a gas stream, and an exit for said atomized process stream.

6. The process of claim 1, wherein said microwave energy is supplied using a power supply having a harmonic frequency that is modulated at a frequency in a range of from 100 KHz to 10 MHz.

7. The process of claim 1, wherein a supplemental composition having a dielectric constant greater than that of said liquid or slurry process stream is added to said liquid or slurry process stream prior to or concurrently with said microwave heating.

8. The process of claim 7, wherein said supplemental composition has a dielectric constant of at least 4 or a loss tangent of at least 0.05.

9. The process of claim 1, wherein a supplemental liquid having a boiling point of less than that of said process stream is added to said liquid or slurry prior to or concurrently with said microwave heating.

10. The process of claim 9, wherein said supplemental liquid has a boiling point of less than 200° C.

11. A furnace atomizer assembly for use in a combustion furnace, comprising:

a. an atomizer nozzle, b. a microwave cavity surrounding said nozzle, c. means for supplying microwave energy to said microwave cavity, d. means for supplying a gas stream to said microwave cavity, and e. means for conducting an atomized process stream formed in said cavity from a liquid or slurry injected through said nozzle into a combustion region of said furnace under motive force supplied by said gas stream.

* * * * *